US009909800B2

(12) United States Patent
Jung

(10) Patent No.: US 9,909,800 B2
(45) Date of Patent: Mar. 6, 2018

(54) REFRIGERATOR

(71) Applicant: LG Electronics Inc., Seoul (KR)

(72) Inventor: Yongki Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/029,653

(22) PCT Filed: Jan. 21, 2016

(86) PCT No.: PCT/KR2016/000659
§ 371 (c)(1),
(2) Date: Apr. 15, 2016

(87) PCT Pub. No.: WO2016/117944
PCT Pub. Date: Jul. 28, 2016

(65) Prior Publication Data

US 2017/0321952 A1 Nov. 9, 2017

(30) Foreign Application Priority Data

Jan. 22, 2015 (KR) ..... 10-2015-0010394

(51) Int. Cl.
*F25D 23/00* (2006.01)
*F25D 23/02* (2006.01)
(Continued)

(52) U.S. Cl.
CPC ..... *F25D 23/028* (2013.01); *E05D 15/505* (2013.01); *F25D 23/04* (2013.01);
(Continued)

(58) Field of Classification Search
CPC . F25D 23/028; F25D 2323/025; F25D 25/025
See application file for complete search history.

(56) References Cited

U.S. PATENT DOCUMENTS 5,040,857 A * 8/1991 Mandel ..... E05D 3/022 16/364
9,163,870 B2 * 10/2015 Jeon ..... F25D 23/028
(Continued)

FOREIGN PATENT DOCUMENTS

CN 102425908 4/2012
JP H05322434 12/1993
(Continued)

OTHER PUBLICATIONS

International Search Report and Written Opinion in International Application No. PCT/KR2016/000659, dated Apr. 5, 2016, 9 pages.
(Continued)

*Primary Examiner* — Daniel J Rohrhoff
(74) *Attorney, Agent, or Firm* — Fish & Richardson P.C.

(57) ABSTRACT

Disclosed is a refrigerator. The refrigerator includes a cabinet having a storage compartment, a first door pivotably installed to the cabinet, the first door being configured to open or close one side of the storage compartment, a second door pivotably installed to the cabinet, the second door being configured to open or close a remaining side of the storage compartment, the second door having a pillar configured to be rotated so as to come into contact with the first door, a first link device provided outside of the storage compartment, the first link device being operated in contact with the first door and the second door at a top of the cabinet, and a second link device configured to be operated by the first link device, the second link device serving to rotate the pillar.

20 Claims, 9 Drawing Sheets

(51) Int. Cl.

| | |
|---|---|
| ***F25D 23/04*** | (2006.01) |
| ***E05D 15/50*** | (2006.01) |
| *F25C 5/00* | (2018.01) |

(52) U.S. Cl.

CPC ..... *F25C 5/005* (2013.01); *F25D 2323/02* (2013.01); *F25D 2400/18* (2013.01)

(56) References Cited

U.S. PATENT DOCUMENTS

| | | | | |
|---|---|---|---|---|
| 9,631,857 | B2 * | 4/2017 | Yoon | E06L 37/18 |
| 2005/0046319 | A1 * | 3/2005 | Chekal | F25D 11/02 312/401 |
| 2010/0141107 | A1 * | 6/2010 | Kim | F25D 23/028 312/405 |
| 2011/0048060 | A1 * | 3/2011 | Kim | E05L 317/0029 62/449 |
| 2011/0083461 | A1 * | 4/2011 | Kim | F25D 23/028 62/264 |
| 2014/0097733 | A1 * | 4/2014 | Seo | F25D 23/02 312/324 |
| 2017/0234602 | A1 * | 8/2017 | Seo | F25D 11/00 348/151 |
| 2017/0299254 | A1 * | 10/2017 | Kim | |

FOREIGN PATENT DOCUMENTS

| | | |
|---|---|---|
| JP | H08-170871 | 7/1996 |
| JP | 09101079 | 4/1997 |
| JP | 10054648 | 2/1998 |
| JP | 2001033150 | 2/2001 |
| JP | 2003121061 | 4/2003 |
| KR | 10-2006-0075396 | 7/2006 |
| KR | 20110040037 | 4/2011 |
| KR | 20140147970 | 12/2014 |

OTHER PUBLICATIONS

Korean Notice of Allowance in Korean Application No. 10-2015-0010394, dated Dec. 26, 2016, 1 page (English translation only).

Extended European Search Report in European Application No. 16740417.7, dated Nov. 10, 2017, 7 pages (with English translation).

* cited by examiner

[Fig. 1]
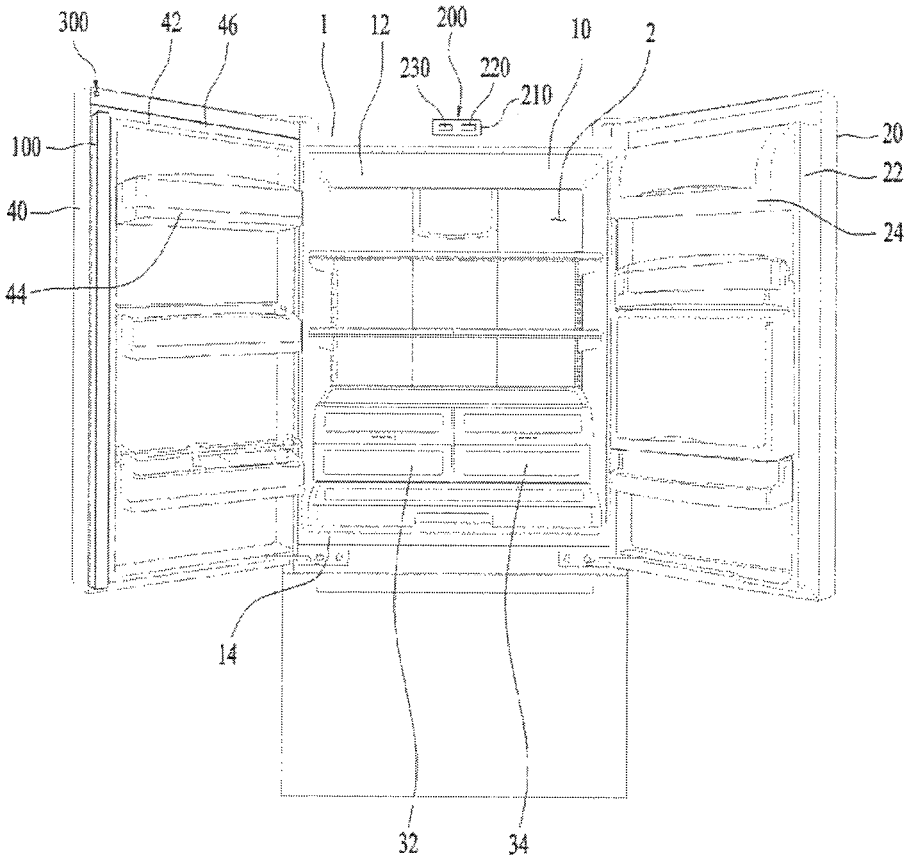

[Fig. 2]
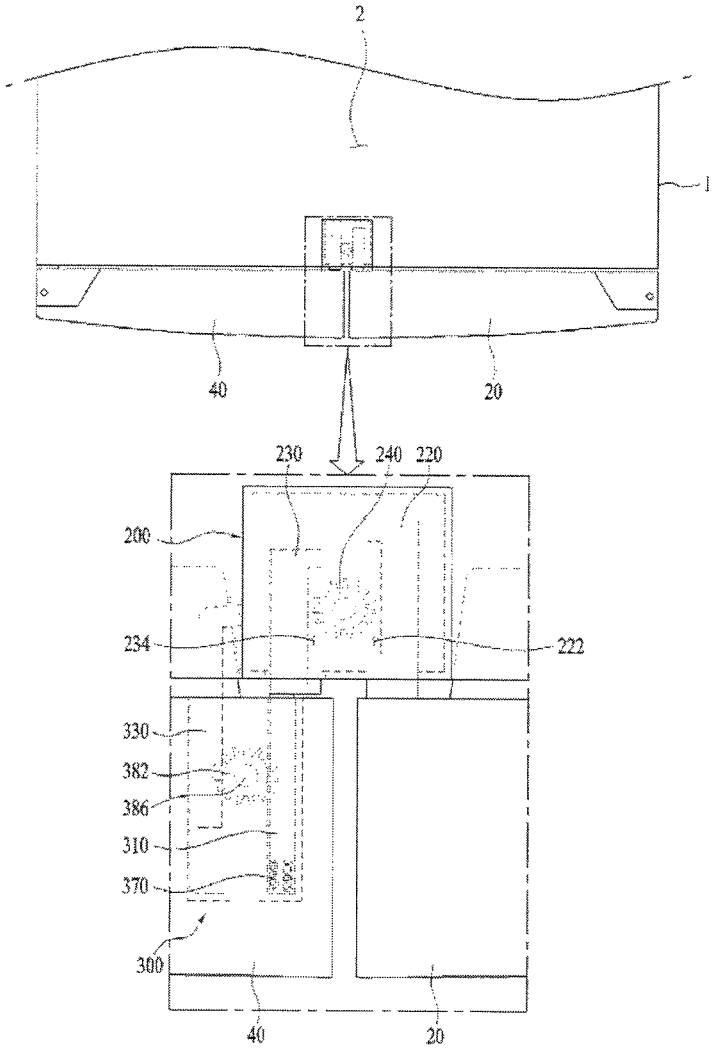

[Fig. 3]
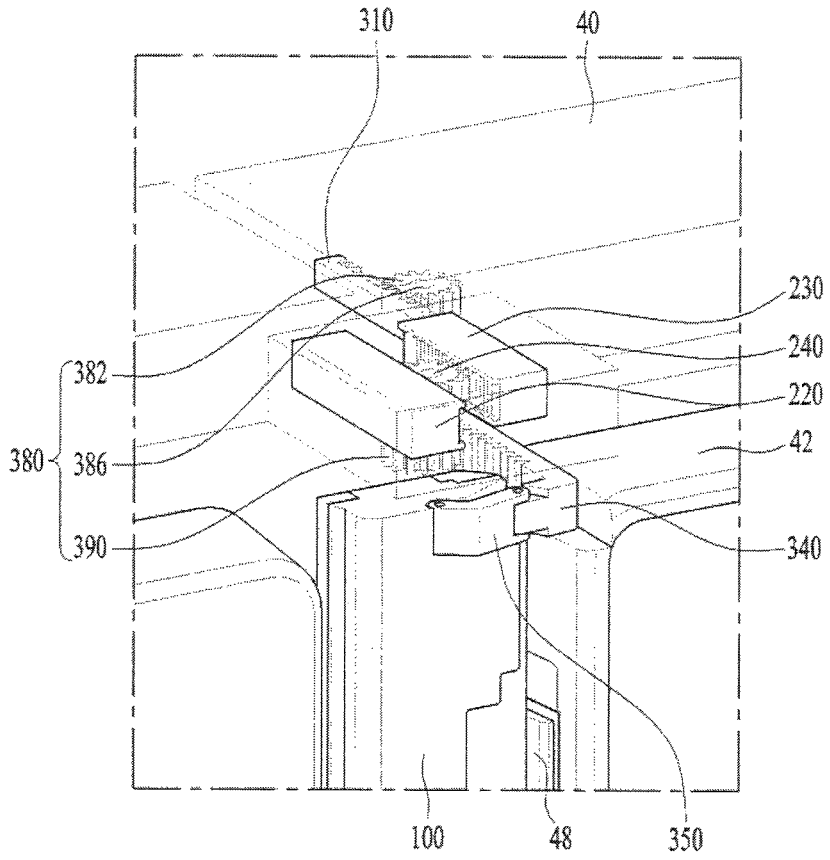

[Fig. 4]
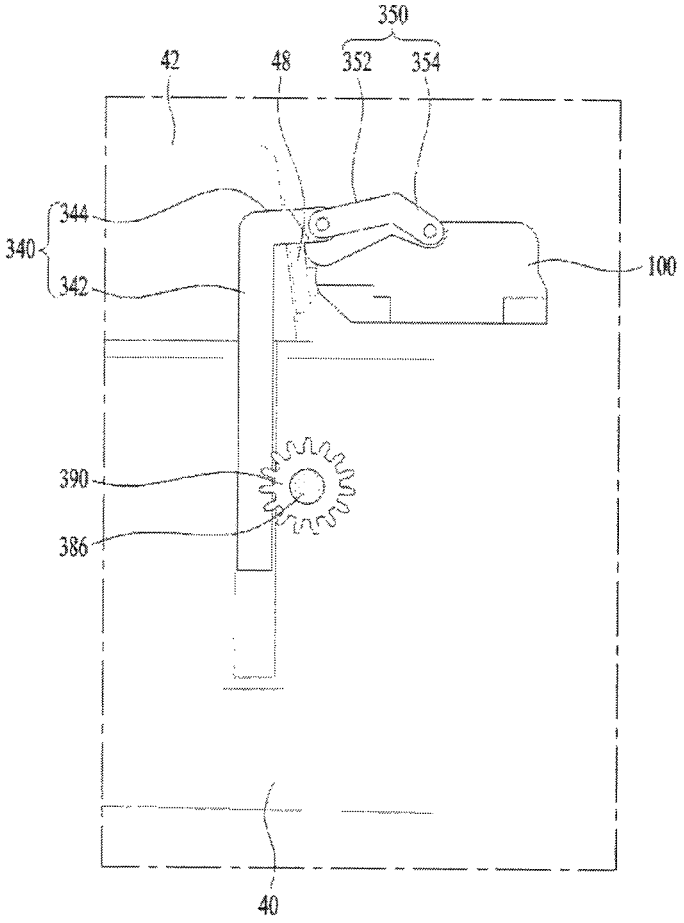

[Fig. 5]
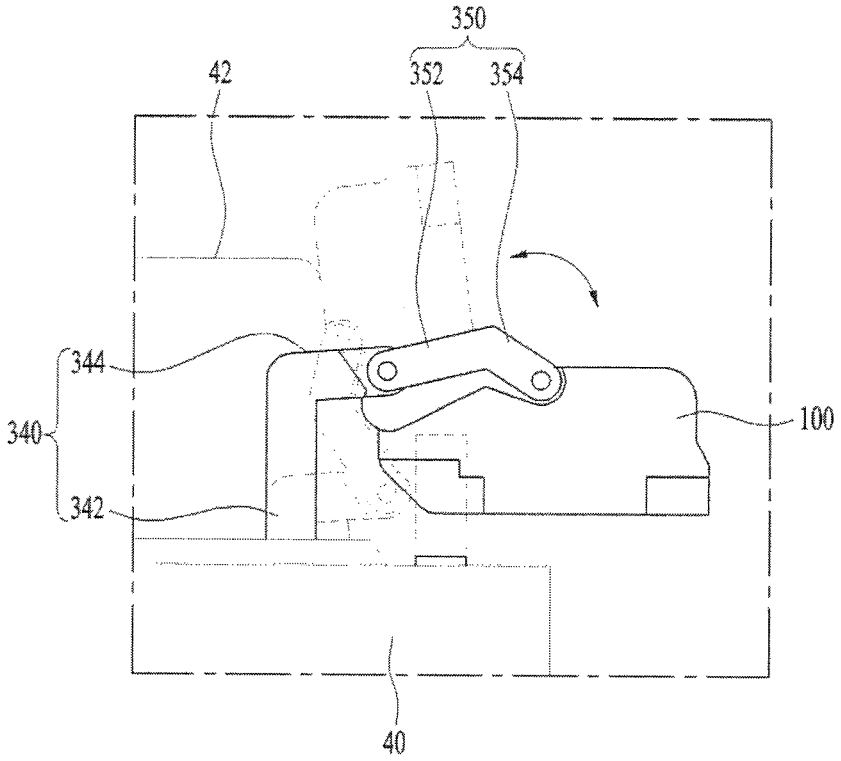

[Fig. 6]
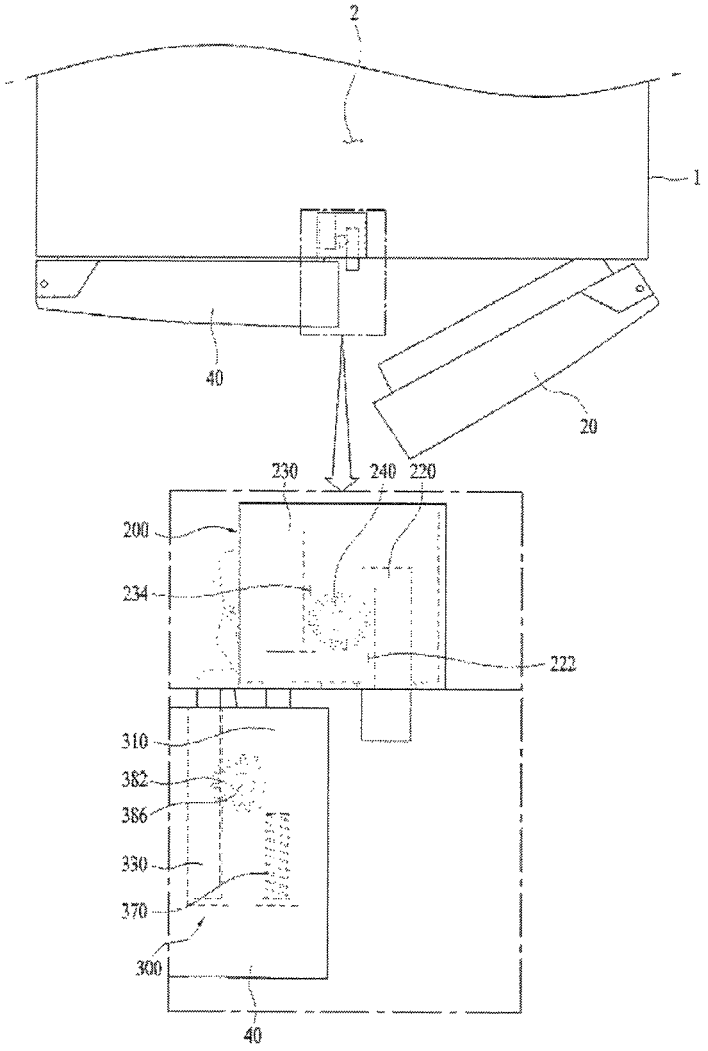

[Fig. 7]
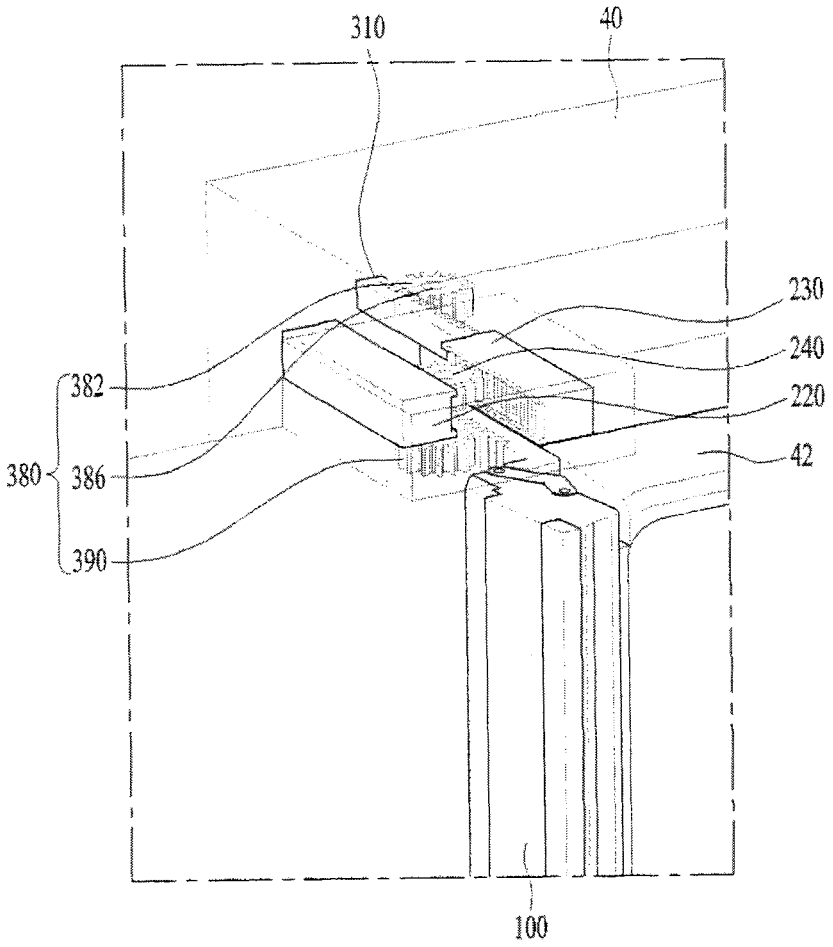

[Fig. 8]
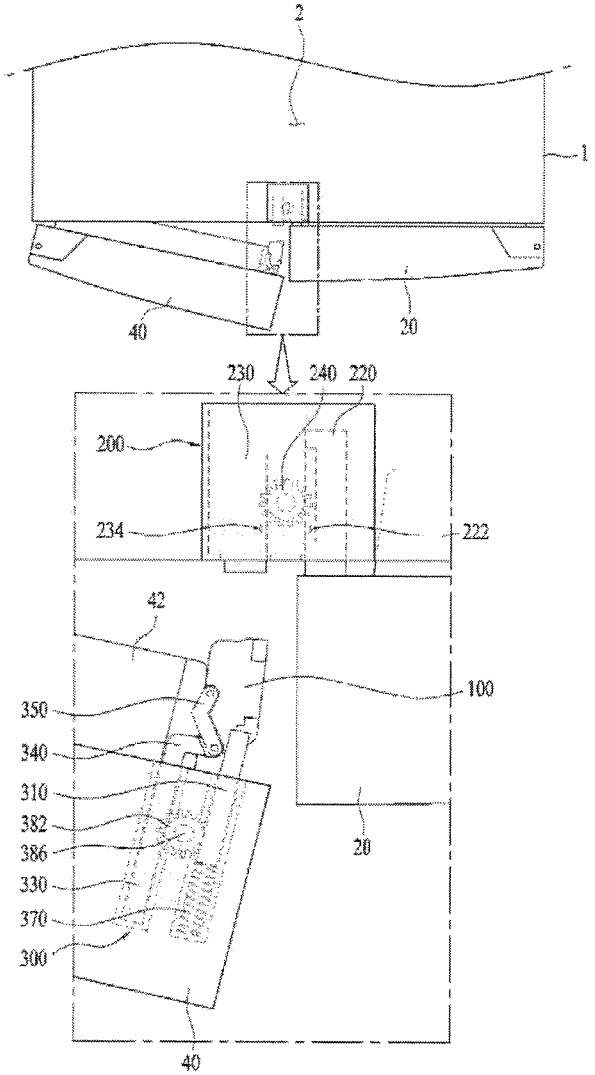

[Fig. 9]
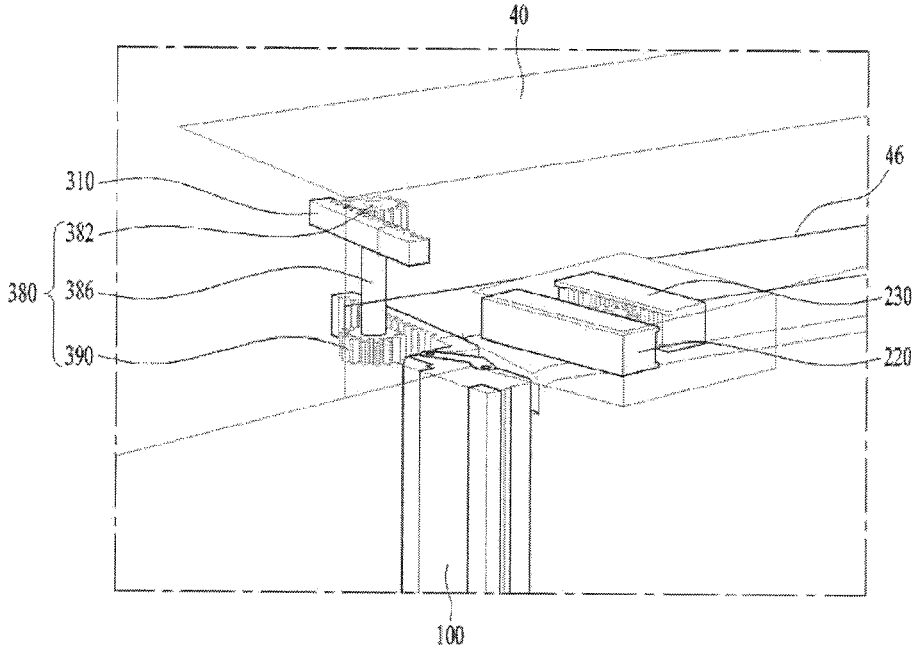
[Fig. 10]
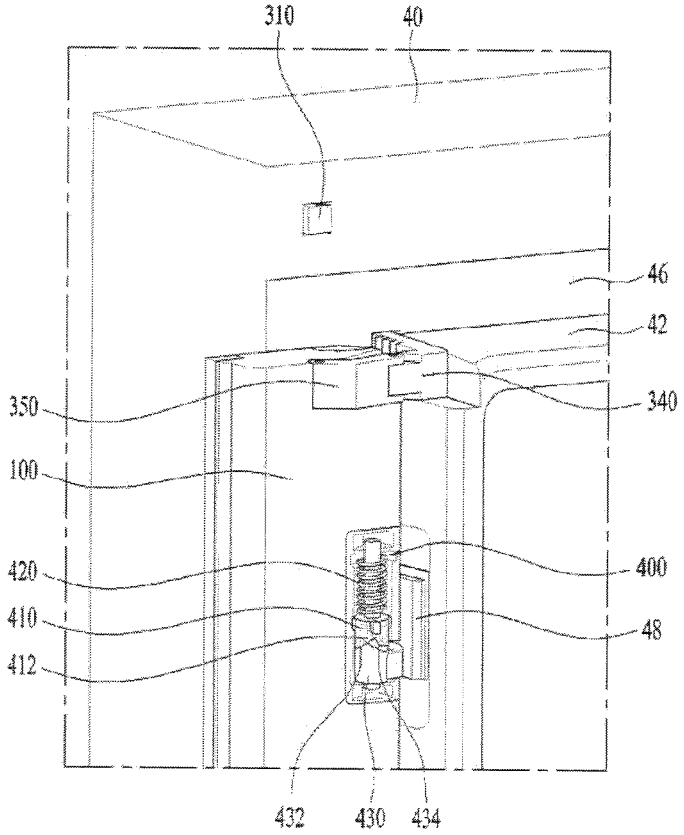

REFRIGERATOR

CROSS REFERENCE TO RELATED APPLICATIONS

This application is a U.S. National Phase Application under 35 U.S.C. § 371 of International Application PCT/KR2016/000659 filed on Jan. 21, 2016, which claims the benefit of Korean Application No. 10-2015-0010394, filed on Jan. 22, 2015, the entire contents of which are hereby incorporated by reference in their entireties.

TECHNICAL FIELD

The present invention relates to a refrigerator and, more particularly, to a refrigerator having improved convenience of use, the refrigerator being a dual door type refrigerator in which two doors are used to open a single storage compartment.

BACKGROUND ART

Generally, a refrigerator is an apparatus that may keep food fresh for a certain duration by cooling a storage compartment (e.g. a freezing compartment or a refrigerating compartment) while repeating a refrigeration cycle.

The refrigerator includes a compressor, which compresses refrigerant, circulating through a refrigeration cycle, into high-temperature and high-pressure refrigerant. The refrigerant compressed in the compressor cools air while passing through a heat exchanger, and the cooled air is supplied to the freezing compartment or the refrigerating compartment.

The refrigerator has a configuration in which the freezing compartment is at the upper side and the refrigerating compartment is at the lower side. A side by side type refrigerator may be configured such that the freezing compartment and the refrigerating compartment are arranged on the left and right sides, respectively, so as to be adjacent to each other.

In addition, there is another type of refrigerator in which a single storage compartment, provided in the upper or lower region of the refrigerator, may be opened by two doors, which are arranged side by side.

In the case where two doors are arranged side by side to open or close a single storage compartment, a pillar is installed on one of the two doors. The pillar is provided only at one of the two doors and is configured to come into contact with the two doors when the two doors close the storage compartment, thereby functioning to improve the sealing efficiency of the storage compartment.

According to the related art, generally, in order to rotate the pillar, a configuration including a protrusion and a guide groove is formed in an inner case of the refrigerator so as to guide the rotation of the pillar.

With the related art, therefore, a user suffers from inconvenience when using the storage compartment because the configuration for guiding the rotation of the pillar needs to be formed so as to protrude downward from the top of the inner case.

In addition, in the state in which the door provided with the pillar hermetically seals the storage compartment, the pillar is unfolded away from the corresponding door, and may block the path along which a drawer installed in the refrigerator moves. Therefore, when two drawers are installed parallel to each other, it is necessary to provide the two drawers with different widths.

In addition, it is necessary to form a basket installed on the door such that a corner of the basket defines a gently curved surface so as not to come into contact with the unfolded pillar when the basket is rotated along with the door. This may problematically cause a reduction in the storage capacity of the basket.

DISCLOSURE OF INVENTION

Technical Problem

Therefore, the present invention has been made in view of the above problems, and it is an object of the present invention to provide a refrigerator having improved convenience of use, the refrigerator being a dual door type refrigerator in which two doors are used to open a single storage compartment.

Solution to Problem

In accordance with one aspect of the present invention, the above and other objects can be accomplished by the provision of a refrigerator including a cabinet having a storage compartment, a first door pivotably installed to the cabinet, the first door being configured to open or close one side of the storage compartment, a second door pivotably installed to the cabinet, the second door being configured to open or close a remaining side of the storage compartment, the second door having a pillar configured to be rotated so as to come into contact with the first door, a first link device provided outside of the storage compartment, the first link device being operated in contact with the first door and the second door at a top of the cabinet, and a second link device configured to be operated by the first link device, the second link device serving to rotate the pillar.

The first link device may include a housing coupled to the top of the cabinet, and the housing may be located outside of the storage compartment, which is closed by the first door and the second door, cold air not being supplied to an inside of the housing.

The first link device may further include a first bar configured to be pushed by the first door, a second bar configured to be pushed by the second door, and a rotation gear engaged and rotated between the first bar and the second bar.

When any one of the first bar or the second bar is moved in a rearward direction of the cabinet, the remaining one thereof may be moved in a forward direction of the cabinet.

The first bar and the second bar may respectively include accommodation regions, in which part of the rotation gear is accommodated, and the rotation gear may be placed in the accommodation regions so as to overlap the first bar and the second bar.

The first bar and the second bar may be located lower than a maximum height of the first door and the second door.

The second link device may include a first link member configured to be pushed and operated by the first link device, a second link member configured to rotate the pillar, and a transmission member configured to transmit an operation of the first link member to the second link member.

The second link device may further include an elastic member configured to elastically support the first link member so that the first link member is moved in a rearward direction of the cabinet when external force applied to the first link member is removed.

When any one of the first link member or the second link member is moved in a rearward direction of the cabinet, a remaining one thereof may be moved in a forward direction of the cabinet.

The transmission member may include a first rotator configured to be engaged with and rotated by the first link member, a second rotator configured to be engaged with and rotated by the second link member, and a connection bar configured to connect the first rotator and the second rotator to each other.

The first rotator may be located outside a region defined by a gasket, which is located between the door and the cabinet, and the second rotator may be located inside the region defined by the gasket, which is located between the door and the cabinet.

The connection bar may vertically extend so that installation heights of the first rotator and the second rotator are different from each other.

The second link member may include a first connector configured to be engaged with and moved by the transmission member, and a second connector having one end rotatably connected to the first connector and a remaining end rotatably connected to the pillar.

The first connector may include a first extending portion configured to extend in a rearward direction of the cabinet, and a second extending portion configured to extend toward the first door at a prescribed angle in relation to the first extending portion.

The first connector may be linearly moved so as to maintain a constant distance between the second extending portion and the first door.

The second connector may include a first connecting portion connected to the second extending portion, and a second connecting portion bent from the first connecting portion at a prescribed angle.

The second connector may simultaneously perform linear movement and rotation when the first connector is linearly moved.

A connection portion of the first connecting portion and the second extending portion may be linearly moved when the first connector is linearly moved.

A connection portion of the second connecting portion and the pillar may be rotated when the first connector is linearly moved.

The second connecting portion may have the same rotation direction as a rotation direction of the pillar.

The first connecting portion may have a longer length than a length of the second connecting portion.

The refrigerator may further include a rotation assistance device installed to a rotating shaft configured to rotate the pillar, the rotation assistance device serving to assist rotation of the pillar.

The rotation assistance device may include a first cam supported by an elastic member, the first cam being rotated along with the pillar, and a second cam engaged with the first cam.

The second cam may include a first slope, and the first cam may include a protrusion, whereby the pillar may be rotated in a direction in which the pillar is unfolded when the protrusion is rotated along the first slope.

The second cam may include a second slope, and the first cam may include a protrusion, whereby the pillar may be rotated in a direction in which the pillar is folded when the protrusion is rotated along the second slope.

The pillar may be operated so as to be unfolded when the first door and the second door are changed in state so as to close the storage compartment.

In a state in which the first door and the second door close the storage compartment, the pillar may be rotated so as to be folded in relation to the second door when any one of the first door and the second door is rotated to open the storage compartment.

The refrigerator may further include a first drawer located on a side of the first door, and a second drawer located on a side of the second door, and the first drawer and the second drawer may have the same width.

The first drawer and the second drawer may be arranged in the same horizontal plane, and the first drawer and the second drawer may be configured so as to be pulled outward independently of each other.

The first door and the second door may have the same width.

Advantageous Effects of Invention

In accordance with the present invention, because a structure to rotate a pillar does not protrude into a storage compartment, the capacity of the storage compartment may be increased, and user inconvenience owing to any protruding structure may be eliminated.

In addition, because the pillar is not unfolded in the state in which only a door provided with the pillar closes the storage compartment and an opposite door opens the storage compartment, a drawer installed on the side of the opposite door is not caught by the pillar when the drawer is pulled out. This may allow a pair of drawers installed on opposite sides to have the same width.

In addition, because the pillar is not unfolded in the state in which only the door provided with the pillar closes the storage compartment and the opposite door opens the storage compartment, a basket installed on the opposite door is not caught by the pillar when the opposite door is rotated. Accordingly, the basket may be formed to have an angled corner, and thus the storage capacity of the basket may be increased.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a front view illustrating a refrigerator in accordance with an embodiment of the present invention;

FIG. 2 is a view illustrating the closed state of a first door and a second door in accordance with the embodiment;

FIG. 3 is a view illustrating the state of a pillar in FIG. 2;

FIG. 4 is a view illustrating major components of FIG. 3;

FIG. 5 is a view illustrating the rotation of the pillar;

FIG. 6 is a view illustrating the open state of the first door in accordance with the embodiment;

FIG. 7 is a view illustrating the state of the pillar in FIG. 6;

FIG. 8 is a view illustrating the open state of the second door in accordance with the embodiment;

FIG. 9 is a view illustrating the state of the pillar in FIG. 8; and

FIG. 10 is a view illustrating a rotation assistance device to assist the rotation of the pillar.

BEST MODE FOR CARRYING OUT THE INVENTION

Hereinafter, exemplary embodiments of the present invention will be described in detail with reference to the accompanying drawings in order to concretely realize the objects as set forth above.

In the drawings, the sizes or shapes of components may be exaggerated to emphasize more clearly the explanation in the drawings and for convenience. In addition, the terms, which are specially defined in consideration of the configuration and operations of the present invention, may be replaced by other terms based on intensions of users and operators or customs. The meanings of these terms should be construed based on the whole content of this specification.

FIG. 1 is a front view illustrating a refrigerator in accordance with an embodiment of the present invention.

Referring to FIG. 1, the refrigerator in accordance with the embodiment includes a cabinet 1, which defines the external appearance of the refrigerator.

The cabinet 1 has a storage compartment 2 in which food may be stored.

The external appearance of the storage compartment 2 may be defined by an inner case 10, which is provided inside the cabinet 1. The inner case 10 may include a top wall 12 and a bottom wall 14, which form the inner surface of the storage compartment 2. The front side of the storage compartment 2 may be open, so as to allow a user to access the storage compartment 2 through the front side of the storage compartment 2.

The cabinet 1 is provided at the front side thereof with a first door 20 and a second door 40. The first door 20 is pivotably installed to the cabinet 1 and serves to open or close one side of the storage compartment 2, and the second door 40 is pivotably installed to the cabinet 1 and serves to open or close a remaining side of the storage compartment 2. Here, the storage compartment 2 may be wholly closed when both the first door 20 and the second door 40 close the front side of the storage compartment 2.

The second door 40 may be provided with a pillar 100, which is rotated so as to come into contact with the first door 20. The pillar 100 may generally have a rectangular shape and may be coupled to the second door 40 so as to be rotatable relative to the second door 40.

The pillar 100 has a shorter length than the distance between the top wall 12 and the bottom wall 14 of the inner case 10, so as not to come into contact with the top wall 12 and the bottom wall 14. That is, even if the second door 40 is rotated and closes the storage compartment 2, the pillar 100 does not come into contact with both the top wall 12 and the bottom wall 14. Each of the top wall 12 and the bottom wall 14 may define a single plane owing to the structural shape of the inner case 10, i.e. because no constituent element configured to limit the rotation of the pillar 100 is arranged on the top wall 12 or the bottom wall 14.

The first door 20 may have a door dike 22, which defines the external appearance of the rear side of the first door 20. In addition, the second door 40 may have a door dike 42, which defines the external appearance of the rear side of the second door 40.

Baskets 44 and 24 may be installed to the respective door dikes 42 and 22 and may be configured to store various shapes of food therein. Here, in the case of the basket 24, which is provided at the first door 20, which is not provided with the pillar 100, the corner thereof may have an angular shape because the basket 24 does not interfere with the pillar 100 when the first door 20 is rotated. Therefore, the amount of food to be stored in the basket 24 may be increased compared to the case where the basket 24 has a rounded corner.

The storage compartment 2 may include a first drawer 34 located on the side of the first door 20 and a second drawer 32 located on the side of the second door 40. Here, the first drawer 34 and the second drawer 32 may be disposed in the same horizontal plane. That is, the first drawer 34 and the second drawer 32 may be arranged on the left and right sides respectively at the same height within the storage compartment 2. The first drawer 34 and the second drawer 32 may be pulled outward independently of each other.

The first drawer 34 and the second drawer 32 may have the same width. That is, the first drawer 34 and the second drawer 32 may have the same storage capacity, and may be replaced with each other. When the first drawer 34 and the second drawer 32 have different widths, and thus have different shapes, the two drawers need to be differently fabricated, which may increase manufacturing costs. On the other hand, when the two drawers have the same shape, this is advantageous in terms of a reduction in manufacturing costs.

In the embodiment of the present invention, the function described above may be implemented because the pillar 100 is not located in the path along which the first drawer 34 is pulled outward when the first door 20 is opened and the first drawer 34 is pulled outward in the state in which the second door 40 closes the storage compartment 2. The reason why the pillar 100 is not located in the path will be described later with reference to other drawings.

Meanwhile, in the embodiment of the present invention, the first door 20 and the second door 40 may be the same width. Thus, the first door 20 and the second door 40 may share some of the production processes thereof, which may reduce the production costs of the doors. The reason for this will be described later with reference to other drawings.

In particular, no constituent elements for operating the pillar 100 are provided on the top wall 12 or on the bottom wall 14 of the inner case 10. As such, because the pillar 100 may extend lengthwise between the top wall 12 and the bottom wall 14, the contact area between the first door 20, the second door 40, and the pillar 100 may be increased. Because the pillar 100 has an increased length compared to the related art, the efficiency with which the storage compartment 2 is hermetically sealed by the pillar 100 may be improved. Accordingly, the inner case 10 is not provided with any inwardly protruding parts, which may prevent sanitary problems caused when impurities such as, for example, food or dust, become adhered to the protruding parts.

In the present embodiment, a first link device 200 is provided at the outside of the storage compartment 2 and is configured to be operated in contact with the first door 20 and the second door 40 at the top of the cabinet 1.

The first link device 200 may include a housing 210, which defines the external appearance of the first link device 200, and a first bar 220 and a second bar 230, which are pushed into or pulled out of the housing 210. The housing 210 may be coupled to the top of the cabinet 1 so as to be pushed by coming into contact with corner portions of the first door 20 and the second door 40.

At this time, because the housing 210 is separated from the storage compartment 2, rather than being connected thereto, cold air supplied to the storage compartment 2 does not move into the housing 210. Thus, the housing 210 does not need to be thermally insulated using an insulating material, or does not need to have a hermetically sealed configuration in order to prevent cold air from moving outward. That is, the housing 210 is a structure that is located outside of the storage compartment 2, which is closed by the first door 20 and the second door 40.

The internal configuration of the storage compartment 2 is not complicated by the housing 210 because the housing 210 is not installed inside the storage compartment 2. Thus, it is possible to prevent impurities such as, for example, food from being jammed inside the storage compartment 2.

In addition, because the housing 210 is installed outside of the cabinet 1, constituent elements thereof may be easily replaced by an operator in the case of failures thereof.

In addition, the second door 40 may be provided with a second link device 300, which is operated by the first link device 200 and serves to rotate the pillar 100. Here, one side of the second link device 300 may be partially exposed from a corner portion of the second door 40, and thus may be pushed by the second bar 230. Meanwhile, the other side of the second link device 300 may be connected to the pillar 100 so as to allow the pillar 100 to be rotated according to the operation of the second bar 230.

FIG. 2 is a view illustrating the closed state of the first door and the second door in accordance with the embodiment, FIG. 3 is a view illustrating the state of the pillar in FIG. 2. FIG. 4 is a view illustrating major components of FIG. 3, and FIG. 5 is a view illustrating the rotation of the pillar.

As illustrated in FIGS. 2 and 3, the first link device 200 may include the first bar 220, which is pushed by the first door 20, the second bar 230, which is pushed by the second door 40, and a rotation gear 240 rotatably engaged between the first bar 220 and the second bar 230.

That is, the first bar 220 and the second bar 230 are movably coupled to teeth of the rotation gear 240 interposed therebetween. As such, when any one of the first bar 220 and the second bar 230 is moved in the rearward direction of the cabinet 1, the other one of the first bar 220 and the second bar 230 is moved in the forward direction of the cabinet 1.

The first bar 220 and the second bar 230 have accommodation regions 222 and 234 respectively, in which part of the rotation gear 240 is accommodated. The rotation gear 240 may be placed in the accommodation regions 222 and 234 so as to overlap the first bar 220 and the second bar 230 respectively. As such, the space in which the first bar 220, the second bar 230, and the rotation gear 240 are installed may be reduced because the first bar 220, the second bar 230, and the rotation gear 240 overlap each other.

In addition, the coupling force between the first bar 220, the second bar 230, and the rotation gear 240 may be increased because the top and bottom of the rotation gear 240 are surrounded by the top and bottom surfaces of the accommodation regions 222 and 234.

As exemplarily illustrated in FIG. 3, the first bar 220 and the second bar 230 are located lower than the maximum height of the first door 20 and the second door 40. This is because the first bar 220 and the second bar 230 need to be pushed by the first door 20 and the second door 40 respectively. Meanwhile, the first bar 220 and the second bar 230 are installed in the space into which no cold air is supplied from the storage compartment 2.

The second link device 300 includes a first link member 310, which is pushed and operated by the first link device 200, a second link member 330, which is configured to rotate the pillar 100, and a transmission member 380, which transmits the operation of the first link member 310 to the second link member 330.

The second link device 300 includes an elastic member 370, which elastically supports the first link member 310 so that the first link member 310 is moved in the rearward direction of the cabinet 1 when external force applied to the first link member 310 is removed. At this time, the first link member 310 may be inserted into a guide groove, and the elastic member 370 may be provided in one end of the guide groove.

When the first link member 310 is moved in the forward direction of the cabinet 1, the elastic member 370 is compressed. On the other hand, when the first link member 310 is moved in the rearward direction of the cabinet 1, the elastic member 370 may be tensioned.

At this time, the first link member 310 and the second link member 330 may be installed at different heights.

The transmission member 380 may include a first rotator 382, which is engaged with and rotated by the first link member 310, a second rotator 390, which is engaged with and rotated by the second link member 330, and a connection bar 386, which connects the first rotator 382 and the second rotator 390 to each other.

The first rotator 382 and the second rotator 390 may take the form of rotation gears having teeth, and the connection bar 386 may connect rotating shafts of the first rotator 382 and the second rotator 390 to each other so that the rotation of the first rotator 382 is transmitted to the second rotator 390. In particular, as the first rotator 382 and the second rotator 390 are engaged with the connection bar 386 without the risk of spinning within no traction, the rotation of the first rotator 382 may be directly transmitted to the second rotator 390.

Accordingly, when any one of the first link member 310 and the second link member 330 is moved in the rearward direction of the cabinet 1, the other one of the first link member 310 and the second link member 330 may be moved in the forward direction of the cabinet 1.

Meanwhile, the connection bar 386 vertically extends so that the first rotator 382 and the second rotator 390 are installed at different heights. As such, the first rotator 382 is located higher than the second rotator 390, and the first link member 310 is located higher than the second link member 330.

The first rotator 382 may be located outside a region defined by a gasket 46, which is located between the second door 40 and the cabinet 1, and the second rotator 390 may be located inside the region defined by the gasket 46 located between the second door 40 and the cabinet 1.

The gasket 46 comes into contact with the pillar 100 or the cabinet 1 so as to allow the storage compartment 2 to be hermetically sealed when the first door 20 and the second door 40 close the storage compartment 2. The gasket 46 is disposed in a rectangular form along the peripheral contour of the corners of the second door 40. As such, the inside of a rectangle and the outside of the rectangle may be partitioned from each other by the gasket 46. The inside of the rectangle, defined by the gasket 46, may mean the space in the storage compartment 2 in which cold air is distributed.

The first link member 310 and the second link member 330 may be arranged to overlap each other when viewed from the top side because the first rotator 382 and the second rotator 390 may have a height difference therebetween owing to the connection bar 386. As such, the front-and-rear space required to install the first link member 310 and the second link member 330 may be reduced. In addition, the thickness of the insulating material of the second door 40 may be reduced because the first link member 310 and the second link member 330 are installed so as to overlap each other.

The first link member 310 may have teeth corresponding to the teeth of the first rotator 382 so as to be engaged with the first rotator 382.

As exemplarily illustrated in FIGS. 4 and 5, the second link member 330 may include a first connector 340, which is engaged with and moved by the transmission member 380, and a second connector 350, which is rotatably connected at one end thereof to the first connector 340 and is also rotatably connected at a remaining end thereof to the pillar 100.

The first connector 340 may include a first extending portion 342, which extends in the rearward direction of the cabinet 1, and a second extending portion 344, which extends toward the first door 20 at a prescribed angle in relation to the first extending portion 342. Each of the first extending portion 342 and the second extending portion 344 takes the form of an elongated bar. The first extending portion 342 and the second extending portion 344 constitute a single member so as not to move relative to each other and to maintain a prescribed angle therebetween.

Owing to the configuration in which the first extending portion 342 and the second extending portion 344 are arranged at a prescribed angle, the pillar 100 may be easily rotated by force transmitted from the first link member 310. Assuming that the first link member 310 is shaped to extend only in the longitudinal direction thereof, it is difficult to cause the pillar 100 to be rotated by the first link member 310.

The second connector 350 may include a first connecting portion 352, which is connected to the second extending portion 344, and a second connecting portion 354, which is bent from the first connecting portion 352 at a prescribed angle. Each of the first connecting portion 352 and the second connecting portion 354 takes the form of an elongated bar. The first connecting portion 352 and the second connecting portion 354 constitute a single member so as not to move relative to each other and to maintain a prescribed angle therebetween.

At this time, the first connecting portion 352 may be longer than the second connecting portion 354. The pillar 100 may attain a path for easy rotation thereof because the first connecting portion 352 is longer than the second connecting portion 354.

Owing to the configuration in which the first connecting portion 352 and the second connecting portion 354 are arranged at a prescribed angle, the second link member 330 may be operated without interference from other members of the refrigerator. The coupling portion of the second link member 330 and the pillar 100 needs to be rotated in order to ensure that the second link member 330 rotates the pillar 100. Therefore, it is necessary to consider the technical problem whereby interference from other members may occur.

As exemplarily illustrated in FIG. 5, when the first connector 340 is moved in the rearward direction of the cabinet 1 (i.e. in the upward direction in FIG. 5), the first extending portion 342 and the second extending portion 344 are moved together in the rearward direction of the cabinet 1.

That is, the first connector 340 is linearly moved in the forward direction or in the rearward direction of the cabinet 1. Through this linear movement of the first connector 340, the distance between the second extending portion 344 and the first door 20 is equally maintained. On the other hand, when the first connector 340 is linearly moved, the second extending portion 344 is moved away from the second door 40.

At this time, the first connecting portion 352, which is connected to the second extending portion 344, is linearly moved in the rearward direction of the cabinet 1 by the same distance as the linear movement of the second extending portion 344. That is, when the first connector 340 is linearly moved, the connection portion of the first connecting portion 352 and the second extending portion 344 is linearly moved.

On the other hand, when the first connector 340 is linearly moved, the connection portion of the second connecting portion 354 and the pillar 100 is rotated. In addition, the pillar 100 is rotated about the rotation axis thereof because the connection portion of the second connecting portion 354 and the pillar 100 is rotatable. The pillar 100 may be rotatably provided on a pillar coupling portion 48, which is provided at one side of the door dike 42. As such, the pillar coupling portion 48 may provide the axis of rotation of the pillar 100, and the rotation of the pillar 100 about the axis of rotation may be guided such that the connection portion of the second connecting portion 354 and the pillar 100 is located far away from the axis of rotation.

At this time, the second connecting portion 354 is rotated in the same direction as the pillar 100.

When the first connector 340 is linearly moved, the second connector 350 simultaneously performs linear movement and rotation. Therefore, the pillar 100 may be rotated when the first connector 340 is linearly moved.

The state in which the storage compartment 2 is closed by the first door 20 and the second door 40 will be described below with reference to FIGS. 2 and 3.

In the state in which both the first door 20 and the second door 40 close the storage compartment 2, the first door 20 pushes the first bar 220 and the second door 40 pushes the second bar 230.

At this time, the first door 20, which pushes the first bar 220, is not easily deformed, and therefore pushes the first bar 220 with relatively strong force.

On the other hand, in relation to the second door 40, the second bar 230 is pushed by the first link member 310 installed to the second door 40, rather than the second door 40. Because one end of the second bar 230 is supported by the elastic member 370, the elastic member 370 may be compressed.

Because the first bar 220 is pushed by the first door 20 and the second bar 230 is moved in the forward direction of the cabinet 1 as the rotation gear 240 is rotated, the first link member 310 is moved in the forward direction of the cabinet 1 while compressing the elastic member 370.

Meanwhile, as the first link member 310 is moved in the forward direction of the cabinet 1, the first link member 310 may rotate the first rotator 382. At this time, the second rotator 390, which is connected to the first rotator 382 via the connection bar 386, is also rotated.

Accordingly, the second link member 330, which is engaged with the second rotator 390, may be moved in the rearward direction of the cabinet 1. Thereby, because the first connector 340 and the second connector 350 are moved rearward, the pillar 100 may be unfolded so as to come into contact with the first door 20 and the second door 40 as exemplarily illustrated in FIG. 3.

FIG. 6 is a view illustrating the open state of the first door in accordance with the embodiment, and FIG. 7 is a view illustrating the state of the pillar in FIG. 6.

Referring to FIGS. 6 and 7, the second door 40 closes the storage compartment 2 and the first door 20 opens the storage compartment 2.

At this time, the pillar 100 is in the folded state, rather than being unfolded toward the first door 20. Thus, the pillar 100 is not located in the movement path of the drawer located on the side of the first door 20 when the drawer is pulled outward. Accordingly, because the pillar 100 does not cover the drawer located on the side of the first door 20 when the drawer is pulled outward, the drawer located on the side of the first door 20 may have an increased width.

In addition, the basket provided on the rear side of the first door 20 may have an angular shape. This is because, although the basket located on the rear side of the first door 20 may catch on the pillar 100 when the first door 20 is rotated, in the present embodiment, the pillar 100 is not located in the path along which the basket located on the rear side of the first door 20 is rotated, but is folded toward the second door 40. Accordingly, the basket located on the rear side of the first door 20 may have an increased storage capacity.

The first door 20 does not push the first bar 220. Thus, the first link member 310 is moved in the rearward direction of the cabinet 1 because the elastic member 370 provided at the first link member 310 tends to return to its original shape.

The first link member 310 moves the second bar 230 in the rearward direction of the cabinet 1, and the first bar 220 is moved in the forward direction of the cabinet 1 by the rotation gear 240.

Because the first link member 310 is moved in the rearward direction of the cabinet 1, the first rotator 382 is rotated counterclockwise, and the second rotator 390 is also rotated counterclockwise. As such, as the second link member 330 is moved in the forward direction of the cabinet 1, the second link member 330 pulls the pillar 100 in the forward direction of the cabinet 1, whereby the pillar 100 may be rotated so as to be folded.

Meanwhile, to allow the second door 40 to continuously close the storage compartment 2 while coming into contact with the cabinet 1, the restoration force of the elastic member 370 may be smaller than the restoration force by which the contact between the second door 40 and the cabinet 1 is released. The reason for this is that, when the restoration force (tension) of the elastic member 370 is too great to keep the second door 40 adjacent to the cabinet 1, the second door 40 may not be kept in contact with the cabinet 1, and the storage compartment 2 may not be closed by the second door 40.

FIG. 8 is a view illustrating the open state of the second door in accordance with the embodiment, and FIG. 9 is a view illustrating the state of the pillar in FIG. 8.

Referring to FIGS. 8 and 9, to allow the second door 40 to be opened in the state in which the first door 20 closes the storage compartment 2, the pillar 100 needs to be in the folded state. Otherwise, the pillar 100 may be caught by the first door 20, thus preventing the second door 40 from being opened.

At this time, when the second door 40 is rotated, the first link member 310 may be moved in the rearward direction of the cabinet 1 by the elastic member 370 because there is no constituent element, such as the second bar 230 that pushes the first link member 310.

Accordingly, the pillar 100 may be folded according to the same principle illustrated in FIGS. 6 and 7. Thus, a detailed description of the related content will be omitted hereinafter.

FIG. 10 is a view illustrating a rotation assistance device to assist the rotation of the pillar.

When the first door 20 and the second door 40 close the storage compartment 2, the pillar 100 needs to come into contact with the first door 20 and the second door 40, in order to keep the storage compartment 2 hermetically sealed. In addition, when the pillar 100 is pushed toward the first door 20 and the second door 40 as force is continuously transmitted to the pillar 100 in a given direction, the pillar 100 has a reduced risk of generating noise owing to slight shaking of the first door 20 or the second door 40. Therefore, the pillar 100 may continuously receive force in the direction in which the pillar 100 is unfolded while being unfolded.

In the present embodiment, the rotation assistance device may be installed to a rotating shaft about which the pillar 100 is rotated. The rotation assistance device serves to assist the pillar 100 in being rotated to the unfolded state thereof. To this end, the rotation assistance device is adapted to continuously apply force to the pillar 100 such that the pillar 100 is moved to the unfolded state thereof.

In addition, in the state in which any one of the first door 20 and the second door 40 is rotated in order to open the storage compartment 2, the pillar 100 needs to be kept folded. At this time, the force by which the pillar 100 is folded needs to be continuously applied to the pillar 100, which prevents the generation of vibrations or noise caused when the second door 40 is rotated.

In the present embodiment, the rotation assistance device, designated by reference numeral 400, provides a configuration to keep the pillar 100 folded.

The rotation assistance device 400 includes a first cam 410, which is supported by an elastic member and is rotated along with the pillar 100, and a second cam 430, which is engaged with the first cam 410.

The second cam 430 has a first slope 423 formed on one side of an upwardly facing surface thereof, and a second slope 434 at the opposite side of the first slope 423.

At this time, the first slope 432 and the second slope 434 may abut each other, and the contact portion of the first slope 432 and the second slope 434 may protrude upward further than the remaining portion. That is, the overall shape of the first slope 432 and the second slope 434 may resemble a mountain.

In addition, the first cam 410 is formed with a protrusion 412, which is configured to come into contact with the first slope 432 or the second slope 434 so that the movement of the protrusion 412 is guided by the first slope 432 or the second slope 434. At this time, the protrusion 412 may be generally shaped such that the central portion thereof protrudes downward and such that the height thereof gradually increases at opposite ends thereof.

The first cam 410 may be coupled to the pillar 100 so as to rotate in the same manner as the pillar 100 without the risk of spinning with no traction.

Accordingly, in the case where the protrusion 412 is present between the first slope 432 and the second slope 434, the protrusion 412 is guided along the first slope 432 or the second slope 434, thus guiding the rotation of the pillar 100.

With the rotation assistance device 400, the pillar 100 continuously receives force in the direction in which the pillar 100 is unfolded toward the first door 20 and the second door 40, or in the direction in which the pillar 100 is folded.

Meanwhile, when external force is applied to rotate the pillar 100, the protrusion 412 of the first cam 410 may be moved along any one of the first slope 432 and the second slope 434 of the second cam 430.

That is, when external force is applied to rotate the pillar 100, an elastic member 420 may be temporarily compressed because the protrusion 412 is moved along the first slope 432 or the second slope 434. Thereby, the first cam 410 may be moved upward so as to become far away from the second cam 430.

When the protrusion 412 is rotated so as to become closer to either one of the adjacent portions of the first slope 432 and the second slope 434 than to the other one, the protrusion 412 is moved downward along the first slope 432 or the second slope 434.

That is, the pillar 100 is rotated when the protrusion 412 is rotated along the first slope 432 or the second slope 434. The pillar 100 may receive supplementary rotation force from the elastic member 420, which elastically supports the pillar 100.

In addition, once the protrusion 412 has been sufficiently guided along the first slope 432 or has been sufficiently guided along the second slope 434, the pillar 100 is no longer rotated unless external force sufficient to compress the elastic member 420 is applied.

Accordingly, the pillar 100 may be kept folded or unfolded by the rotation assistance device 400.

In particular, in the state in which the first door 20 is closed and only the second door 40 is opened, the second bar 230 does not push the second link device 300. The elastic member 370 is tensioned to the original state thereof as the external force applied thereto is removed. At this time, the elastic member 370 compresses part of the elastic member 420 while returning to the original state thereof, thereby changing the pillar 100 into the folded state. That is, the force required to tension the elastic member 370 from the compressed state to the original state may be greater than the force required to compress the elastic member 420.

Likewise, in the state in which the second door 40 is closed and only the first door 20 is opened, the second bar 230 does not push the second link device 300 with sufficient force. This is because the first bar 220 cannot prevent the movement of the second bar 230 because there is no constituent element for preventing the movement of the first bar 220. The elastic member 370 is tensioned to the original state thereof because no sufficient external force is applied to the elastic member 370. At this time, the elastic member 370 compresses part of the elastic member 420 while returning to the original state thereof, thereby changing the pillar 100 to the folded state. That is, the force required to tension the elastic member 370 from the compressed state to the original state may be greater than force required to compress the elastic member 420.

The present invention is not limited to the embodiments described above, various other alterations of the embodiments are possible by those skilled in the part as can be appreciated from the accompanying claims, and these alterations fall within the scope of the present invention.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a refrigerator.

The invention claimed is:

1. A refrigerator comprising:

a cabinet having a storage compartment;

a first door pivotably installed to the cabinet, the first door being configured to open or close one side of the storage compartment;

a second door pivotably installed to the cabinet, the second door being configured to open or close a remaining side of the storage compartment, the second door having a pillar configured to be rotated so as to come into contact with the first door;

a first link device provided outside of the storage compartment, the first link device being operated in contact with the first door and the second door at a top of the cabinet; and a second link device configured to be operated by the first link device, the second link device serving to rotate the pillar.

2. The refrigerator according to claim 1, wherein the first link device includes a housing coupled to the top of the cabinet, and wherein the housing is located outside of the storage compartment, which is closed by the first door and the second door, cold air not being supplied to an inside of the housing.

3. The refrigerator according to claim 2, wherein the first link device further includes:

a first bar configured to be pushed by the first door;

a second bar configured to be pushed by the second door; and a rotation gear engaged and rotated between the first bar and the second bar.

4. The refrigerator according to claim 3, wherein the first bar and the second bar respectively include accommodation regions, in which part of the rotation gear is accommodated, and wherein the rotation gear is placed in the accommodation regions so as to overlap the first bar and the second bar.

5. The refrigerator according to claim 1, wherein the second link device includes:

a first link member configured to be pushed and operated by the first link device;

a second link member configured to rotate the pillar; and a transmission member configured to transmit an operation of the first link member to the second link member.

6. The refrigerator according to claim 5, wherein the second link device further includes an elastic member configured to elastically support the first link member so that the first link member is moved in a rearward direction of the cabinet when external force applied to the first link member is removed.

7. The refrigerator according to claim 5, wherein the transmission member includes:

a first rotator configured to be engaged with and rotated by the first link member;

a second rotator configured to be engaged with and rotated by the second link member; and a connection bar configured to connect the first rotator and the second rotator to each other.

8. The refrigerator according to claim 7, wherein the first rotator is located outside a region defined by a gasket, which is located between the door and the cabinet, and wherein the second rotator is located inside the region defined by the gasket, which is located between the door and the cabinet.

9. The refrigerator according to claim 5, wherein the second link member includes:

a first connector configured to be engaged with and moved by the transmission member; and a second connector having one end rotatably connected to the first connector and a remaining end rotatably connected to the pillar.

10. The refrigerator according to claim 9, wherein the first connector includes:

a first extending portion configured to extend in a rearward direction of the cabinet; and a second extending portion configured to extend toward the first door at a prescribed angle in relation to the first extending portion.

11. The refrigerator according to claim 9, wherein the second connector includes:

a first connecting portion connected to the second extending portion; and a second connecting portion bent from the first connecting portion at a prescribed angle.

12. The refrigerator according to claim 11, wherein the second connector simultaneously performs linear movement and rotation when the first connector is linearly moved.

13. The refrigerator according to claim 11, wherein the first connecting portion has a longer length than a length of the second connecting portion.

14. The refrigerator according to claim 1, further comprising a rotation assistance device installed to a rotating shaft configured to rotate the pillar, the rotation assistance device serving to assist rotation of the pillar.

15. The refrigerator according to claim 14, wherein the rotation assistance device includes:

a first cam supported by an elastic member, the first cam being rotated along with the pillar; and a second cam engaged with the first cam.

16. The refrigerator according to claim 1, wherein the pillar is operated so as to be unfolded when the first door and the second door are changed in state so as to close the storage compartment.

17. The refrigerator according to claim 1, wherein, in a state in which the first door and the second door close the storage compartment, the pillar is rotated so as to be folded in relation to the second door when any one of the first door and the second door is rotated to open the storage compartment.

18. The refrigerator according to claim 1, further comprising:

a first drawer located on a side of the first door; and a second drawer located on a side of the second door, wherein the first drawer and the second drawer have the same width.

19. The refrigerator according to claim 18, wherein the first drawer and the second drawer are arranged in the same horizontal plane, and wherein the first drawer and the second drawer are configured so as to be pulled outward independently of each other.

20. The refrigerator according to claim 1, wherein the first door and the second door have the same width.

* * * * *